US008733911B2

(12) United States Patent
Mizutani et al.

(10) Patent No.: US 8,733,911 B2
(45) Date of Patent: May 27, 2014

(54) LIQUID CONTAINER INK JET PRINTER HAVING THE LIQUID CONTAINER

(75) Inventors: Tadahiro Mizutani, Shiojiri (JP); Izumi Nozawa, Matsumoto (JP); Hiroyuki Nakamura, Shiojiri (JP); Shun Oya, Matsumoto (JP); Taku Ishizawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 7 days.

(21) Appl. No.: 13/072,472

(22) Filed: Mar. 25, 2011

(65) Prior Publication Data

US 2011/0234719 A1 Sep. 29, 2011

(30) Foreign Application Priority Data

Mar. 29, 2010 (JP) ..... 2010-74382

(51) Int. Cl.
*B41J 2/175* (2006.01)

(52) U.S. Cl.
USPC ..... 347/86

(58) Field of Classification Search
CPC ..... B41J 2002/17516; B41J 2002/17573; B41J 2002/17576; B41J 2002/17679
USPC ..... 847/7, 85, 86
See application file for complete search history.

(56) References Cited

U.S. PATENT DOCUMENTS 5,464,578 A 11/1995 Salter et al.
5,515,092 A 5/1996 Swanson et al.
5,541,632 A 7/1996 Khodapanah et al.
5,640,186 A 6/1997 Swanson et al.
5,675,367 A 10/1997 Scheffelin et al.
5,737,002 A 4/1998 Swanson et al.
5,745,137 A 4/1998 Scheffelin et al.
5,754,207 A 5/1998 Gragg et al.
5,757,390 A 5/1998 Gragg et al.
5,757,406 A 5/1998 Kaplinsky et al.

(Continued)

FOREIGN PATENT DOCUMENTS

EP 0781659 A2 7/1997
EP 0882594 A1 12/1998

(Continued)

OTHER PUBLICATIONS

Extended European Search Report dated Feb. 27, 2012 in corresponding European Patent Appln. No. 11159975.9.

*Primary Examiner* — Alessandro Amari
*Assistant Examiner* — Michael Konczal
(74) *Attorney, Agent, or Firm* — Stroock & Stroock & Lavan LLP

(57) ABSTRACT

A liquid container includes a liquid chamber and a flexible member. The liquid chamber is configured to contain the liquid. The flexible member is subject to deformation with a decrease in internal pressure of the liquid chamber. The liquid container includes a negative pressure generator configured to maintain negative pressure in the liquid chamber by applying pressure to the flexible member. The liquid container includes a liquid outlet configured to feed the liquid out of the liquid chamber. The liquid container includes an air inlet configured to introduce air into the liquid chamber when the internal pressure of the liquid chamber is lowered to or below a preset level. The liquid container includes a detection-associated member for detection of the remaining volume of the liquid in the liquid chamber. The detection-associated member can be located inside the liquid chamber on a wall of the container body.

14 Claims, 5 Drawing Sheets

(56) References Cited

U.S. PATENT DOCUMENTS

| | | | | |
|---|---|---|---|---|
| 5,767,882 | A | 6/1998 | Kaplinsky et al. | |
| 5,852,458 | A | 12/1998 | Scheffelin et al. | |
| 5,874,978 | A | 2/1999 | Swanson et al. | |
| 5,903,292 | A * | 5/1999 | Scheffelin et al. | 347/86 |
| 5,975,330 | A * | 11/1999 | Sasaki et al. | 220/495.01 |
| 5,984,463 | A | 11/1999 | Kozmiski et al. | |
| 6,000,791 | A | 12/1999 | Scheffelin et al. | |
| 6,003,984 | A | 12/1999 | Bohorquez et al. | |
| 6,033,610 | A | 3/2000 | Swanson et al. | |
| 6,053,607 | A | 4/2000 | Kaplinsky et al. | |
| 6,332,675 | B1 | 12/2001 | Koitabashi et al. | |
| 6,341,853 | B1 | 1/2002 | Scheffelin et al. | |
| 6,361,136 | B1 * | 3/2002 | Watanabe et al. | 347/7 |
| 6,585,360 | B1 * | 7/2003 | Dietl | 347/86 |
| 7,424,824 | B2 * | 9/2008 | Usui et al. | 73/290 V |
| 7,703,867 | B2 * | 4/2010 | Katsumura | 347/7 |
| 2002/0145650 | A1 | 10/2002 | Pan et al. | |
| 2003/0035036 | A1 | 2/2003 | Ogura et al. | |
| 2003/0117450 | A1 * | 6/2003 | Usui et al. | 347/7 |
| 2003/0122907 | A1 | 7/2003 | Kim | |
| 2003/0142176 | A1 | 7/2003 | Wu et al. | |
| 2005/0264624 | A1 | 12/2005 | Ogura et al. | |
| 2010/0026742 | A1 * | 2/2010 | Morino | 347/7 |

FOREIGN PATENT DOCUMENTS

| | | | |
|---|---|---|---|
| EP | 1281524 | A2 | 2/2003 |
| EP | 1820652 | A2 | 8/2007 |
| JP | 06-198904 | A | 7/1994 |
| JP | 06-293139 | A | 10/1994 |
| JP | 07-001743 | A | 1/1995 |
| JP | 09-136435 | A | 5/1997 |
| JP | 11-240171 | A | 9/1999 |
| JP | 11-348301 | A | 12/1999 |
| JP | 2002-144598 | A | 5/2002 |
| JP | 2002-540998 | A | 12/2002 |
| JP | 2003-191488 | A | 7/2003 |
| JP | 2003-191491 | A | 7/2003 |
| JP | 2003-191495 | A | 7/2003 |
| JP | 2003-251826 | A | 9/2003 |
| JP | 2009-095981 | A | 5/2009 |
| WO | 0061373 | A1 | 10/2000 |
| WO | 2005/000684 | A2 | 1/2005 |
| WO | 2006/052034 | A1 | 5/2006 |

* cited by examiner

LIQUID CONTAINER INK JET PRINTER HAVING THE LIQUID CONTAINER

CROSS REFERENCE TO RELATED APPLICATIONS

The present application claims the priority based on Japanese Patent Application No. 2010-74382 filed on Mar. 29, 2010, the disclosure of which is hereby incorporated by reference in its entirety.

BACKGROUND

1. Technical Field

The present invention relates to a liquid container containing a liquid to be supplied to a liquid-consuming device and to a liquid-consuming device equipped with such a liquid container.

2. Description of the Related Art

One known structure of the liquid container includes a liquid chamber having a flexible member as its one part. In this liquid container, decreasing a liquid contained in the liquid container changes the bent state of the flexible member to reduce the inner capacity of the liquid chamber.

Another known structure of the liquid container has a prism used for detection of the remaining volume of a liquid contained in the liquid container. This liquid container is connected with an externally located photo interrupter to detect the reflection state of light by the prism and thereby detect the remaining volume of the liquid in the liquid container.

This prior art liquid container, however, fails to detect the remaining volume of the liquid with high accuracy, because of the reason stated below.

In this prior art liquid container, the flexible member has no uniform but varying change of the bent state, which results in changing the inner capacity of the liquid chamber. The prism located at a fixed position enables detection of a liquid level but does not assure highly accurate detection of a decrease in inner capacity of the liquid chamber to or below a preset level. This leads to failed detection of the remaining volume of the liquid in the liquid container with high accuracy.

SUMMARY

By taking into account at least part of the issue discussed above, there is a requirement for enabling highly accurate detection of the remaining volume of a liquid contained in a liquid chamber included in a liquid container and formed to have a flexible member as its one part.

In order to address at least part of the requirement described above, the present invention provides various embodiments and applications described below.

A first aspect of the invention is a liquid container containing a liquid to be supplied to a liquid-consuming device. The liquid container has a liquid chamber configured to contain the liquid, formed to have a flexible member as part thereof, and subjected to reduction of inner capacity of the liquid chamber caused by deformation of the flexible member associated with a decrease in internal pressure of the liquid chamber. The liquid container also has a liquid outlet configured to feed the liquid out of the liquid chamber, a negative pressure generator configured to maintain negative pressure in the liquid chamber, and a detection-associated member for detection of a remaining volume of the liquid in the liquid chamber. The detection-associated member is located in an unaffected area inside the liquid container where a capacity change caused by deformation of the flexible member doesn't occur.

In the liquid container of this aspect, the detection-associated member is located in an unaffected area where a capacity change caused by deformation of the flexible member doesn't occur. Irrespective of a change in bent state of the flexible member, one value detected by using the detection-associated member always represents an identical remaining volume. This arrangement effectively prevents misdetection of the remaining volume of the liquid falling to or below the preset level and thereby improves the detection accuracy of the remaining volume of the liquid in the liquid container.

In one preferable embodiment of the liquid container pertaining to the first aspect, the detection-associated member is used to detect that a liquid level falls to or below a preset level corresponding to a height where the detection-associated member is located. The liquid chamber has: a main chamber formed to have the flexible member as part thereof; a sub-chamber provided in downstream of the main chamber and configured to have the detection-associated member located therein; and a communication path arranged to connect the main chamber with the sub-chamber and configured to have an open end to the sub-chamber located at a higher position than the preset level in posture during use of the liquid container.

In the liquid container of this embodiment, the liquid accumulated below the preset level in the sub-chamber does not flow back through the communication path into the main chamber. The detection-associated member is located in the sub-chamber, which is separate from the main chamber having the flexible member as its part. Irrespective of a change in bent state of the flexible member, a lower area below the preset level in the sub-chamber is not affected by a capacity change. The liquid container of this arrangement thus detects that the liquid level falls to or below the preset level with high accuracy.

In one preferable application of the above embodiment, the liquid container further has an air inlet configured to introduce outside air into the liquid chamber. The air inlet is located above the communication path in posture during use of the liquid container.

The liquid container of this application prevents bubbles produced by the air flowed in via the air inlet from immediately flowing into the sub-chamber. This arrangement lowers the possibility of bubble-induced misdetection of the remaining volume of the liquid and thereby further enhances the detection accuracy of the remaining volume of the liquid in the liquid container.

In another preferable embodiment of the liquid container pertaining to the first aspect, the detection-associated member is located below a boundary of an affected area inside the liquid container, which is subjected to a capacity change caused by deformation of the flexible member, in posture during use of the liquid container.

In the liquid container of this embodiment, irrespective of a change in bent state of the flexible member, the liquid level falling to the preset level is not affected by a capacity change caused by deformation of the flexible member. The liquid container of this arrangement thus detects that the liquid level falls to or below the preset level with high accuracy.

In one preferable application of the above embodiment, the liquid container further has an air inlet configured to introduce outside air into the liquid chamber. The air inlet is located above the detection-associated member in posture during use of the liquid container.

The liquid container of this application prevents bubbles produced by the air flowed in via the air inlet from flowing into the periphery of the detection-associated member. This arrangement further enhances the detection accuracy of the remaining volume of the liquid in the liquid container.

The detection-associated member of the liquid container may be a prism. This arrangement takes advantage of the optical characteristics of the prism to facilitate detection of the remaining volume of the liquid.

A second aspect of the invention is a liquid-consuming device. The liquid-consuming device includes a liquid container and a liquid-consuming assembly configured to consume a liquid contained in the liquid container. The liquid container has a liquid chamber contained the liquid, formed to have a flexible member as part thereof, and subjected to reduction of inner capacity of the liquid chamber caused by deformation of the flexible member associated with a decrease in internal pressure of the liquid chamber. The liquid container also has a liquid outlet configured to feed the liquid out of the liquid chamber, a negative pressure generator configured to maintain negative pressure in the liquid chamber, and a detection-associated member involved in detection of a remaining volume of the liquid in the liquid chamber and located in an unaffected area inside the liquid container, which is not subjected to a capacity change caused by deformation of the flexible member. The liquid-consuming device of this arrangement enables highly accurate detection of the remaining volume of the liquid in the liquid container.

The present invention may be actualized by diversity of other applications including:

(1) liquid supply device and liquid supply method;

(2) ink container and ink supply device; and (3) liquid jet device and inkjet printer.

DESCRIPTION OF THE PREFERRED EMBODIMENTS

Some embodiments of the present invention are described below with reference to the accompanying drawings.

A. First Embodiment

A-1. Structure of Ink Cartridge

Figure 1B:
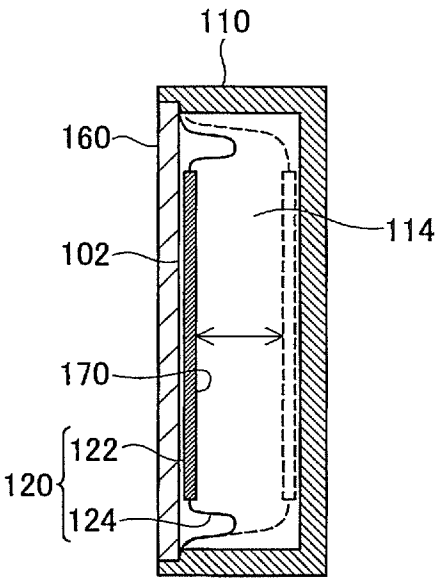
FIGS. 1A through 1C are sectional views of an ink cartridge in a first embodiment of the invention.
Figure 1A:
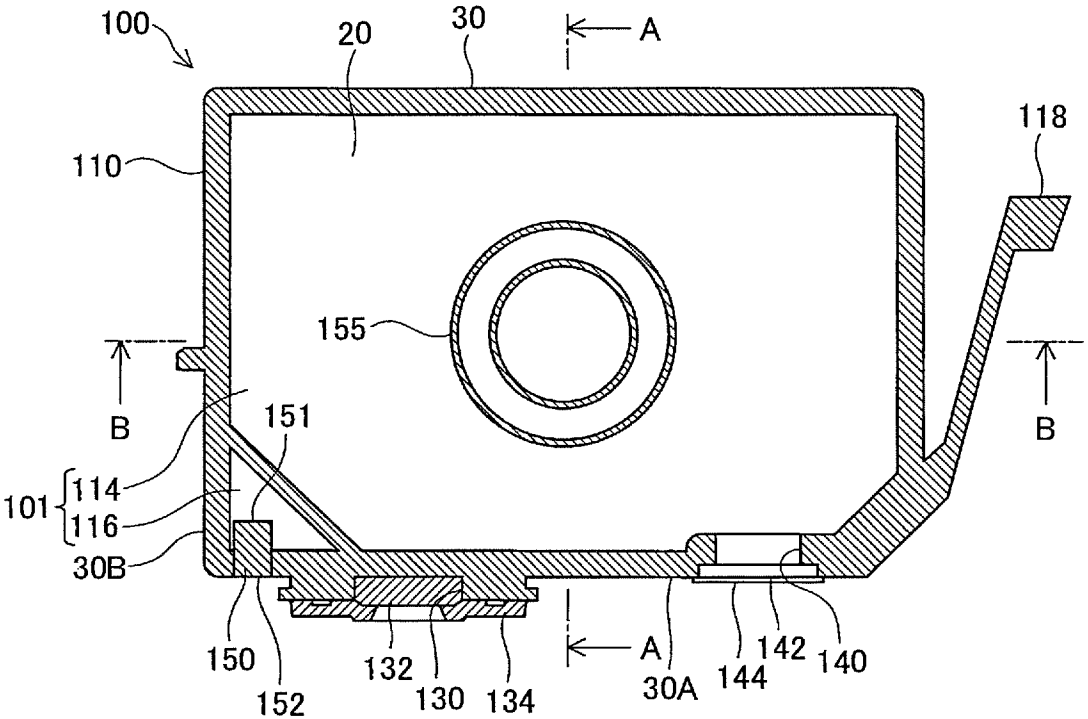
Figure 1C:
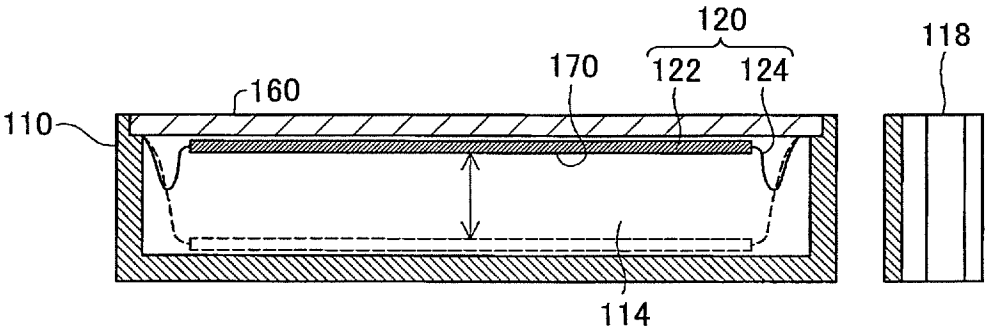
Figure 2:
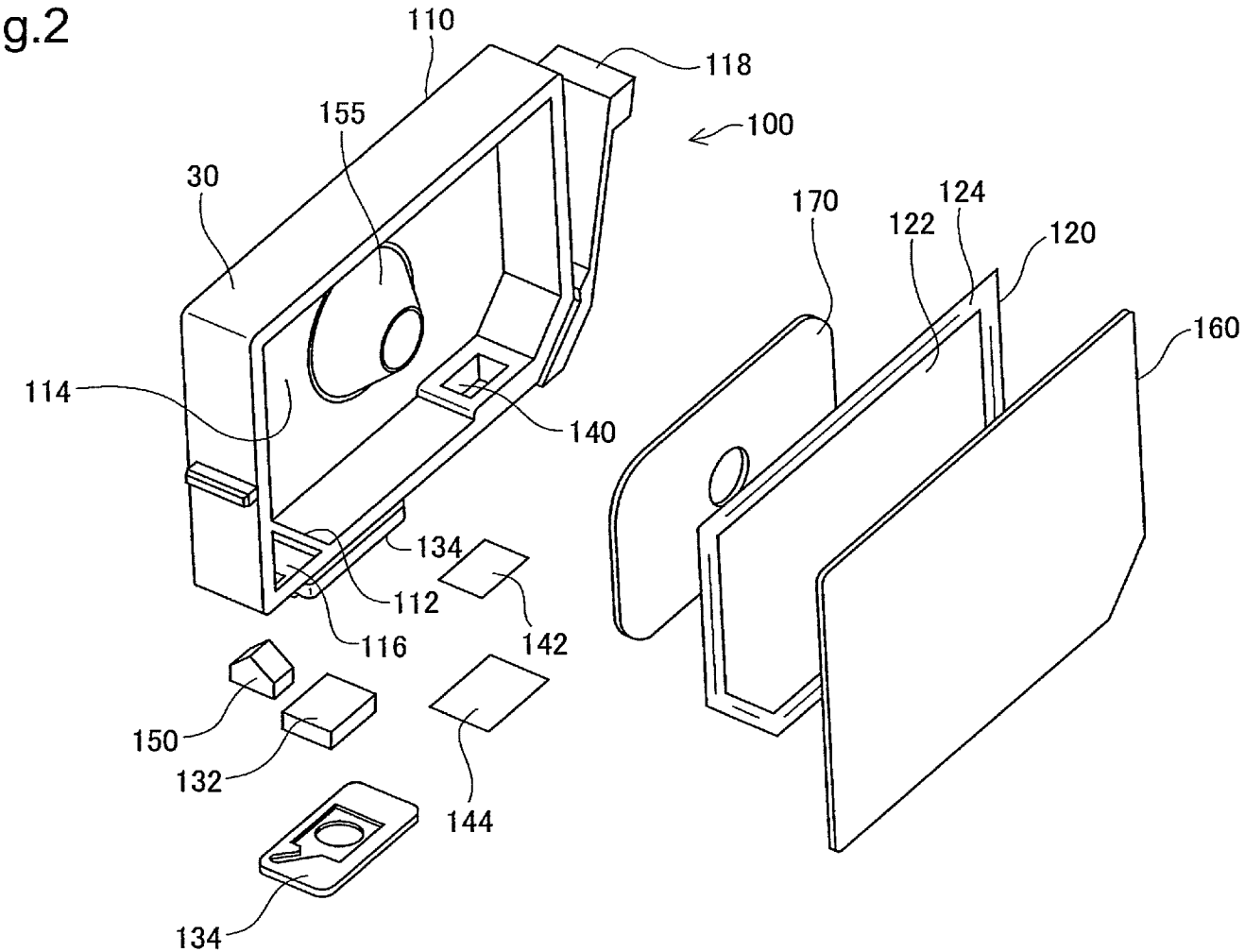
FIG. 2 is an exploded perspective view of the ink cartridge of the first embodiment.

FIGS. 1A through 1C are sectional views of an ink cartridge 100 in a first embodiment of the invention. FIG. 1A shows a plane section of the ink cartridge 100. FIG. 1B is a sectional view taken on a line A-A in FIG. 1A and FIG. 1C is a sectional view taken on a line B-B in FIG. 1A. For better understanding, some of the structure is omitted in these sectional views. FIG. 2 is an exploded perspective view of the ink cartridge 100.

The ink cartridge 100 is for ink jet printers in domestic or office use that are capable of printing on sheets of up to a size A3. The ink jet printer (hereafter simply referred to as "printer") corresponds to the "liquid-consuming device" in the claims of the invention.

Referring to FIGS. 1A through 1C and FIG. 2, the ink cartridge 100 has a container body 110 in a bathtub shape and a cover member 160 provided to be combinable with the container body 110. The container body 110 has a bottom 20 and a side wall 30 arranged to define a container chamber. The container chamber is parted by a partition plate 112 into a main container section 114 and a sub-container section 116. The main container section 114 is formed in a quasi-cuboid and more specifically in an irregular hexagonal column. The sub-container section 116 is formed in a quasi-triangular column. The sub-container section 116 has significantly smaller capacity than that of the main container section 114. The main container section 114 communicates with the sub-container section 116 via a communication hole 50 formed in the partition plate 112 (described later). A release lever 118 is coupled with the side wall 30 of the container body 110.

The cover member 160 is a plate member combined with the container body 110 to seal the container body 110 and form the casing of the ink cartridge 100 in the quasi-cuboid shape. The container body 110 and the cover member 160 may be made of synthetic resin, such as polypropylene (PP) or polyethylene (PE). For better understanding, FIG. 1A shows the plane section of the ink cartridge 100 with removal of the cover member 160, a film 120 (described below), and a pressure-receiving plate 170 (described later).

The main container section 114 in the container body 110 is sealed with the flexible film 120, which has a plane section 122 that is planar in the absence of any external force and a flexure section 124 that is bent or folded in the absence of any external force. The plane section 122 has an irregular hexagonal outline or more specifically a rectangular major outline with two straight cut corners. The outline of the plane section 122 corresponds to the opening shape of the main container section 114. The circumference of the flexure section 124 is welded to a facing end circumference of the side wall 30 of the container body 110 and to a corresponding facing end of the partition plate 112 as shown in FIGS. 1B and 1C. Such welding makes the film 120 sag downward from the end of the side wall 30 of the container body 110 toward the bottom 20 and then go upward to be apart from the bottom 20 to the center plane section 122. The film 120 is mainly composed of polyethylene terephthalate (PET) and polypropylene (PP).

The height of the sub-container section 116 in the container body 110 is greater than the height of the main container section 114 by the thickness of the film 120. This arrangement eliminates the clearance between the sub-container section 116 and the cover member 160 in the assembled ink cartridge 100.

Ink is contained in the space of the main container section 114 parted by the film 120 and in the sub-container section 116. There is the air in a cavity 102 formed by the film 120 in the main container section 114 and the cover member 160. The structure of containing ink is hereafter referred to as "ink chamber 101". The ink chamber 101 accordingly consists of the space of the main container section 114 parted by the film 120 and the sub-container section 116. The capacity (volume) of the ink chamber 101 is varied by displacement of the plane section 122 accompanied with the bend or the stretch of the flexure section 124 of the film 120. More specifically, the ink-containing capacity of the main container section 114 is varied, while the capacity of the sub-container section 116 is kept unchanged. The ink chamber corresponds to the "liquid chamber" included in the liquid container of the invention.

A conical spring 155 is located at the substantial center on the bottom 20 of the container body 110. The conical spring 155 is a coil spring wound in a conical shape and has one end supporting the pressure-receiving plate 170. The pressure-receiving plate 170 has substantially the same shape as that of the plane section 122 of the film 120, i.e., the irregular hexagonal shape. The pressure-receiving plate 170 is superposed on the plane section 122 of the film 120 and is pressed against the plane section 122 and the cover member 160 by means of the conical spring 155. The conical spring 155 accordingly applies the pressure to the pressure-receiving plate 170 in the direction of increasing the capacity of the ink chamber 101. The conical spring 155 corresponds to the "negative pressure generator" included in the liquid container of the invention.

As the ink volume decreases through consumption of ink contained in the ink chamber 101, the negative pressure is generated to attract the pressure-receiving plate 170 and the plane section 122 of the film 120 toward the bottom 20. The position of the pressure-receiving plate 170 in the state of decreased ink volume through the ink consumption is shown by the broken line in FIGS. 1B and 1C. While the film 120 is deformed by the change in internal pressure of the ink chamber 101, the pressure-receiving plate 170 has substantially no deformation even under the change in internal pressure of the ink chamber 101. The pressure-receiving plate 170 is, however, displaced by the deformation of the film 120.

An ink supply hole 130, an air open hole 140, and a prism 150 are arranged on a lower side wall 30A of the container body 110 in posture during use of the ink cartridge 100 attached to the printer. In the description below, the terms "lower" or "below" and "upper" or "above" respectively denote the vertically lower side and the vertically upper side in posture during use of the ink cartridge 100 attached to the printer.

The ink supply hole 130 is formed on the lower side of the main container section 114 to supply ink to the printer. The ink supply hole 130 communicates with the sub-container section 116 via a communication hole (not shown). The ink introduced into the main container section 114 sequentially moves through the sub-container section 116 and the ink supply hole 130 to be supplied to the printer via the ink supply hole 130.

A supply hole foam 132 is placed in the ink supply hole 130 and is fastened by a supply hole cover 134. The supply hole foam 132 is ink-absorbing sponge-like element made of polyethylene terephthalate (PET). The supply hole foam 132 serves to prevent leakage of ink in the tilted attitude of the ink cartridge 100.

The air open hole 140 is formed on the lower side of the main container section 114 to introduce the outside air. The air open hole 140 is covered with an air-permeable film sheet 142, which is further covered with an outer film 144. The air-permeable film sheet 142 has water repellency and porosity and is made of polytetrafluoroethylene (PTFE). The pores of the PTFE material assure formation of a meniscus on the ink surface and enable ink to be contained in the air-permeable film sheet 142. The outer film 144 serves to protect the air-permeable film sheet 142.

In the structure of this embodiment, the air open hole 140 provided on the lower side of the main container section 114 enables the air-permeable film sheet 142 to be filled with ink and allows for formation of a meniscus even on the significantly lowered ink surface.

The prism 150 is an optical element used to detect the remaining volume of ink in the ink chamber 101 and is provided on the lower side of the sub-container section 116. The prim 150 may be made of, for example, polypropylene and is formed in a quasi-isosceles right triangular column or more specifically in an irregular pentagonal column. The prism 150 is arranged, such that its quasi-isosceles right triangular (more specifically, irregular pentagonal) plane of the prism 150 faces or comes in contact with a vertical side face 30B of the ink cartridge 100 and that a side forming a vertex angle 151 of the quasi-isosceles right triangular plane is located on the upper side and a plane 152 facing the vertex angle 151 is located on the lower side. The plane 152 is exposed on the lower face of the ink cartridge 100.

In the structure of the embodiment, the prism 150 is made of polypropylene and is integrally formed with the side wall 30 of the container body 110. The prism 150 is made transparent. This integral structure is, however, not essential for the ink cartridge 100. The container body 110 and the prism 150 may be made of separate members or materials.

Figure 3:
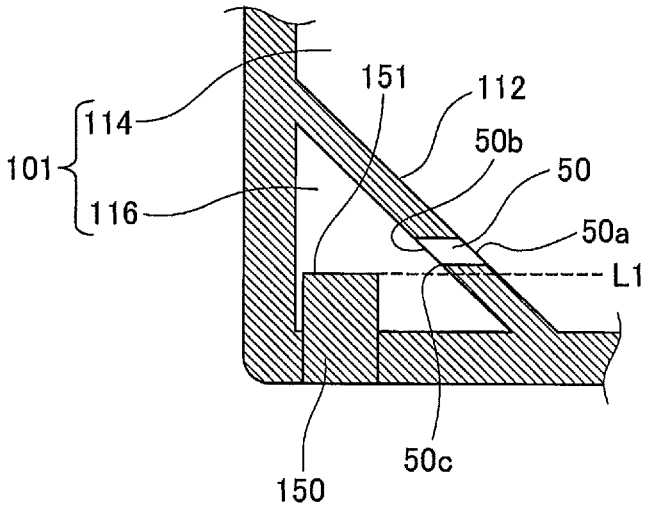
FIG. 3 is an enlarged sectional view of the periphery of a communication hole provided in a partition plate.

FIG. 3 is an enlarged sectional view of the periphery of the communication hole 50 formed in the partition plate 112. The communication hole 50 is formed in a cylindrical shape and has one open end 50*a* connecting with the main container section 114 and the other open end 50*b* connecting with the sub-container section 116. In posture during use of the ink cartridge 100 attached to the printer, the open end 50*b* connecting with the sub-container section 116 is located vertically above position L1 of the vertex angle 151 of the prism 150. More specifically, a lower-most point 50*c* of the open end 50*b* is located above the position L1. In the illustrated example, the length of the communication hole 50 is horizontally arranged in posture during use of the ink cartridge 100 attached to the printer. This horizontal arrangement is, however, not essential. The open end 50*a* of the communication hole 50 connecting with the main container section 114 may be located at the bottom of the main container section 114. Upon satisfaction of the condition that the open end 50*b* connecting with the sub-container section 116 is located above the position L1, the communication hole 50 may be inclined from the horizontal direction.

The above modified structure where the open end 50*a* of the communication hole 50 connecting with the main container section 114 is located at the bottom of the main container section 114 decreases the remaining volume of ink. In this modified structure, the communication hole is preferably made sufficiently thin to enable formation of an ink meniscus.

Locating the open end 50*b* connecting with the sub-container section 116 above the position L1 causes the ink present in a lower area of the sub-container section 116 below the open end 50*b* of the communication hole 50 to be accumulated in the sub-container section 116 and not to flow back toward the main container section 114.

In the structure of the embodiment, the open end 50*b* connecting with the sub-container section 116 is located above the position L1. In another example, the open end 50*b* may be located above a borderline BL (described later). The borderline BL is located below the position L1 and is used as a criterion of detecting "out-of-ink" in prism-based detection of the remaining volume of ink. This alternative arrangement prevents the ink present in a lower area of the sub-container section 116 below the borderline BL as the criterion of "out-of-ink" detection from flowing back toward the main container section 114. The communication hole 50 may thus be formed at any position where the open end 50*b* connecting with the sub-container section 116 is located above (at the higher position than) the borderline BL.

The mechanism of detecting the remaining volume of ink in the ink chamber 101 is explained below. A photo interrupter (described later) is fastened at a position in the printer with the attached ink cartridge 100. In the printer, the ink cartridge 100 carried on a carriage is conveyed to the fastened position of the photo interrupter for detection of the remaining volume of ink.

Figure 4:
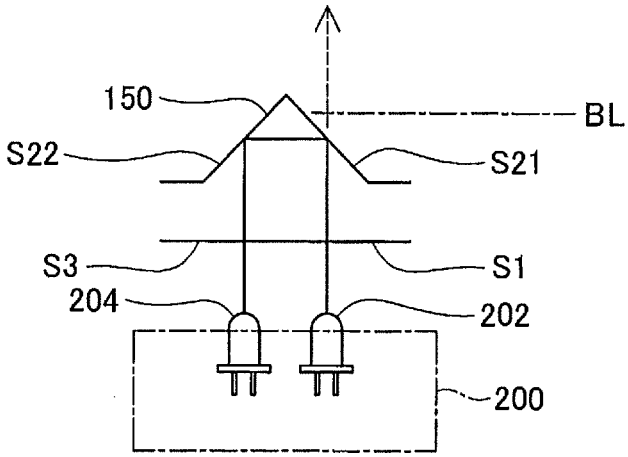
FIG. 4 is an explanatory representation of a photo interrupter with a prism.

FIG. 4 is an explanatory representation of the photo interrupter 200 with the prism 150. For detection of the remaining volume of ink, the photo interrupter 200 is arranged to face the exposed lower plane of the prism 150 as illustrated. The photo interrupter 200 includes a light-emitting element 202 and a light-receiving element 204. Light (e.g., white light) emitted from the light-emitting element 202 is directed onto a right half (in FIG. 4) of the lower plane of the prism 150 (hereafter referred to as "incoming plane S1") and reaches a right inclined plane (in FIG. 4) of the prism 150 (hereafter referred to as "first reflection plane S21"). In the presence of ink in the sub-container section 116, the light reaching the first reflection plane S21 is transmitted through the first reflection plane S21 as shown by the broken line to be absorbed by the ink. In the absence of ink in the sub-container section 116, on the other hand, the light reaching the first reflection plane S21 is reflected by the first reflection plane S21. This phenomenon is ascribed to the difference between the refractive index of polypropylene as the material of the prism 150 to the ink (water) and the refractive index of polypropylene to the air.

In the presence of ink in the sub-container section 116, the light is absorbed by the ink as discussed above, so that the photo interrupter 200 does not detect the reflected light. Detection of no reflected light by the photo interrupter 200 leads to determination of "ink remaining" state. In the absence of ink in the sub-container section 116, on the other hand, the light is reflected by the first reflection plane S21, is further reflected by a left inclined plane (in FIG. 4) of the prism 150 (hereafter referred to as "second reflection plane S22"), and goes out of a left half (in FIG. 4) of the lower plane of the prism 150 (hereafter referred to as "outgoing plane S3"). In the absence of ink in the sub-container section 116, the light-receiving element 204 of the photo interrupter 200 detects the reflected light. Detection of reflected light by the photo interrupter 200 leads to determination of "out-of-ink" state.

The combination of the photo interrupter 200 and the prism 150 gives the detection of "out-of-ink" state on the occasion that the ink level in the sub-container section 116 is lowered to or below the borderline BL shown in FIG. 4. The borderline BL runs in the horizontal direction and is determined according to the position of the prism 150.

A-2. Operations of Ink Cartridge

Referring back to FIGS. 1A through 1C, the operations of the ink cartridge 100 are described below. As the ink is consumed via the supply hole foam 132, the bent film 120 is gradually stretched in the main container section 114 to gradually reduce the space parted by the film 120 (hereafter referred to as "main container section ink chamber"). The reduction of the main container section ink chamber moves the pressure-receiving plate 170 toward the bottom 20 to compress the conical spring 155. The conical spring 155 presses against the plane section 122 of the film 120 and the pressure-receiving plate 170, so that negative pressure is generated in the main container section ink chamber. The compression of the conical spring 155 further lowers the internal pressure of the main container section ink chamber.

When the internal pressure of the main container section ink chamber is lowered to or below a preset level, the ink meniscus is destroyed at the air-permeable film 142 set in the air open hole 140 and the air is flowed through the air open hole 140 into the main container section ink chamber. The air inflow into the main container section ink chamber increases the internal pressure of the main container section ink chamber to form an ink meniscus again at the air-permeable film 142. The formation of the ink meniscus terminates the air inflow into the main container section ink chamber. The repetition of the start and termination of the air inflow into the main container section ink chamber lowers the ink level in the ink chamber 101.

When the ink level is lowered to or below the borderline BL, the prism-based photo interrupter 200 detects the "out-of-ink" state. The "out-of-ink" state is detected with some margin of the remaining ink volume to the actual ink used up.

A-3. Advantages and Effects of Embodiment

Figure 5A:
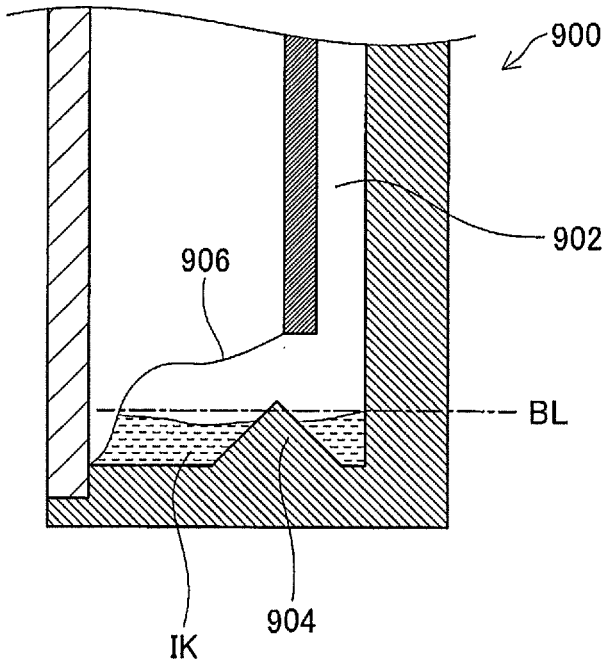
FIGS. 5A and 5B are explanatory representation of the problem to be addressed by the invention.
Figure 5B:
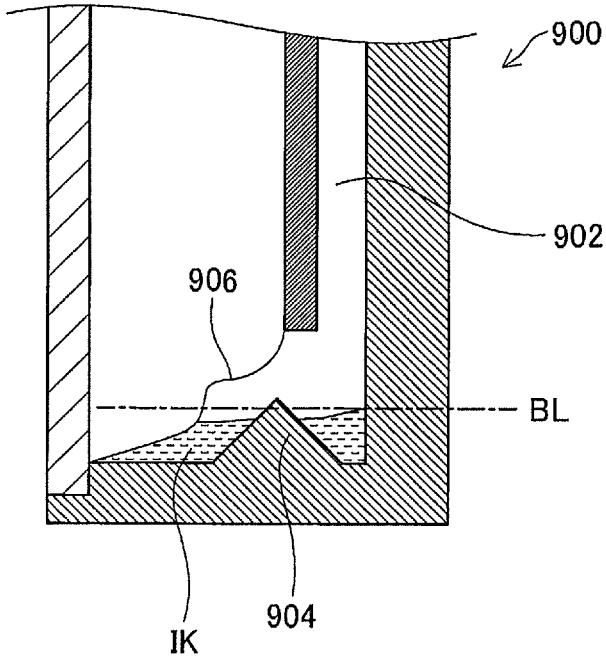

FIGS. 5A and 5B are explanatory representation of the problem to be addressed by the invention. FIGS. 5A and 5B are partially-broken sectional views of a related ink cartridge 900, taken on a line corresponding to the line A-A of FIG. 1A. As shown in FIGS. 5A and 5B, the ink cartridge 900 has a single ink chamber 902, which is not divided into two parts as in the above embodiment. A prism 904 is located inside the ink chamber 902.

A flexible film 906, which is similar to the film 120 of the first embodiment, is deformed with a decrease of the ink volume in the ink chamber 902. FIGS. 5A and 5B show different deformation states of the film 906. The film 906 is bent upward in the state of FIG. 5A, while being bent downward in the state of FIG. 5B. In both these states, a photo interrupter combined with the prism 904 detects the "out-of-ink" state. Since the film 906 is, however, deformed differently in the state of FIG. 5A and in the state of FIG. 5B, there are different remaining volumes of ink IK. This means that the "out-of-ink" state may be detected at different remaining volumes of ink IK in the prior art ink cartridge 900.

In the ink cartridge 100 of the first embodiment, on the other hand, the container chamber is parted by the partition plate 112 into the main container section 114 and the sub-container section 116. The main container section 114 has the film 120, and the sub-container section 116 has the prism 150. The position of the communication hole 50 is determined to cause the ink present in the lower area of the sub-container section 116 below the position L1 of the vertex angle 151 of the prism 150 to be accumulated in the sub-container section 116 and not to flow back toward the main container section 114. Irrespective of the deformation state of the film 120, there is a fixed remaining volume of ink at the detection of the "out-of-ink" state by the photo interrupter 200. This arrangement of the ink cartridge 100 of the first embodiment thus prevents misdetection of the remaining volume of ink to or below a preset level and thereby enhances the detection accuracy.

B. Variations of First Embodiment

B-1. Variation 1 of First Embodiment

A variation of the first embodiment is explained below. In the structure of the first embodiment, the prism 150 and the air open hole 140 are provided separately in the different sections. This arrangement prevents the detection of the "out-of-ink" state from being adversely affected by the air introduced through the air open hole 140. The variation of the first embodiment aims to reduce the potential effects of the air introduced through the air open hole 140.

Figure 6:
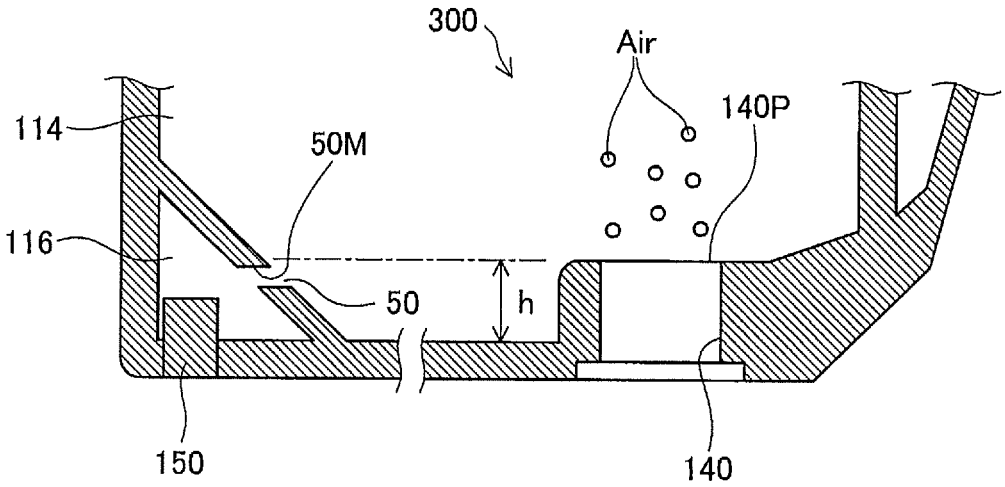
FIG. 6 is a partially-broken sectional view of an ink cartridge as a variation of the first embodiment.

FIG. 6 is a partially-broken sectional view of an ink cartridge 300 as the variation of the first embodiment. The plane section of FIG. 6 corresponds to the plane section of FIG. 1A. The difference of this variation from the first embodiment is only height "h" of an open end 140P of the air open hole 140. Otherwise the structure of this variation is identical with the structure of the first embodiment. As illustrated, the height "h" of the open end 140P of the air open hole 140 is higher than the position of the communication hole 50. The height "h" of the open end 140P is determined to be located above an uppermost line 50M of the communication hole 50.

The structure of this variation prevents the air introduced through the air open hole 140 from flowing through the communication hole 50 into the sub-container section 116. This arrangement keeps the internal pressure of the sub-container section 116 unchanged and thereby further enhances the detection accuracy of the remaining volume of ink by the prism-based photo interrupter, compared with the first embodiment. The air introduced through the air open hole 140 may form bubbles and adhere to the prism 150 to lower the detection accuracy. The structure of this variation significantly prevents the air bubbles from adhering to the prism 150, thus further enhancing the detection accuracy.

B-2. Variation 2 of First Embodiment

In the structure of the first embodiment, the position of the communication hole 50 is determined to cause the ink present in the lower area of the sub-container section 116 below the position L1 of the vertex angle 151 of the prism 150 to be accumulated in the sub-container section 116 and not to flow back toward the main container section 114. As a variation of this structure, a check valve may be set in the communication hole 50 to prevent the backflow of ink from the sub-container section 116 to the main container section 114. This variation has the similar effects to those of the first embodiment.

C. Second Embodiment

Figure 7:
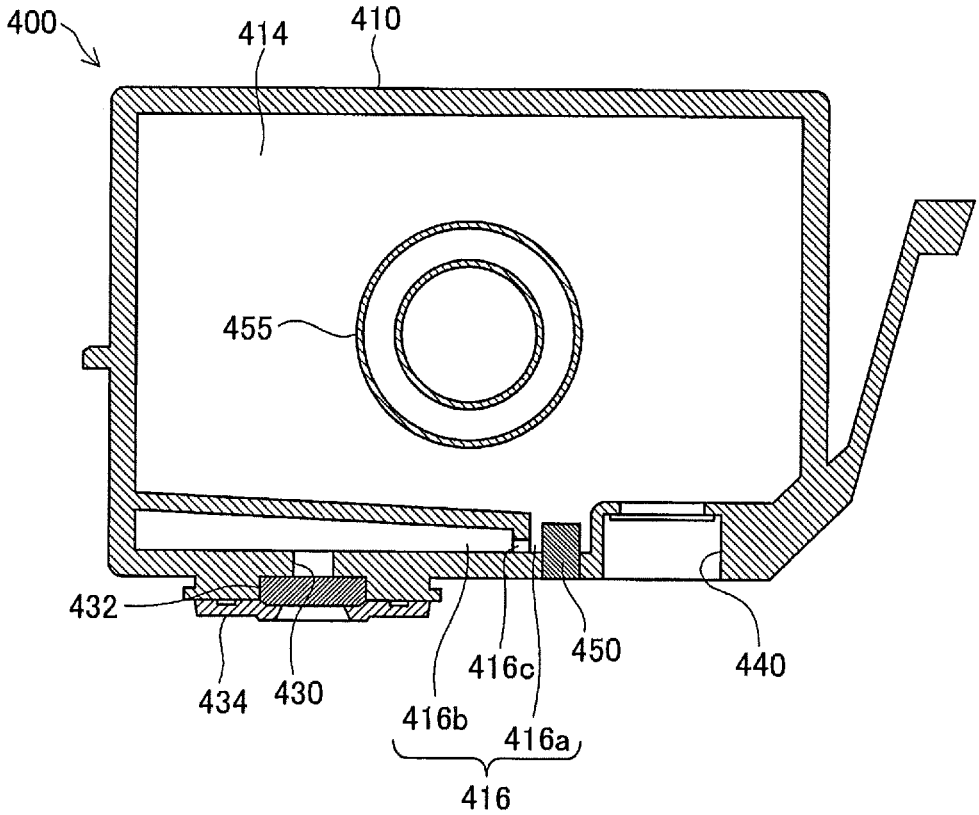
FIG. 7 is a sectional view of an ink cartridge in a second embodiment of the invention.

A second embodiment of the invention is described below. FIG. 7 is a sectional view of an ink cartridge 400 in the second embodiment of the invention. The plane section of FIG. 7 corresponds to the plane section of FIG. 1A. Like FIG. 1A, FIG. 7 shows the plane section of the ink cartridge 400 with removal of a cover member, a film, and a pressure-receiving plate. The primary difference of the ink cartridge 400 of the second embodiment from the ink cartridge 100 of the first embodiment is that a sub-container section 416 is provided below a main container section 414. As explained in the first embodiment, the term "lower" or "below" denotes the vertically lower side in posture during use of the ink cartridge 400 attached to the printer. The ink cartridge 400 has a container body 410, an air open hole 440, and a conical spring 455.

The main container section 414 includes a film and a pressure-receiving plate (not shown) having the same functions as those of the first embodiment. The main container section 414 has the similar functions to those of the main container section 114 of the first embodiment.

The sub-container section 416 has a first sub-chamber 416*a* open to the main container section 414, a second sub-chamber 416*b*, and a communication path 416*c* connecting the first sub-chamber 416*a* with the second sub-chamber 416*b*. A prism 450 is located in the first sub-chamber 416*a*. As in the structure of the first embodiment, the prism 450 is located below the sub-container section 416 and is exposed on the lower face of the ink cartridge 400. The second sub-chamber 416*b* communicates with an ink supply hole 430. Like the first embodiment, a supply hole foam 432 is placed in the ink supply hole 430 and is fastened by a supply hole cover 434.

In posture during use of the ink cartridge 400 of the second embodiment, the prism 450 is located below an area possibly occupied by the deformed film. The ink level lowered to the borderline as the criterion of detection of the "out-of-ink" state by the prism-based photo interrupter has no variation in height, irrespective of the deformation state of the film. The ink cartridge 400 of the second embodiment accordingly has the enhanced detection accuracy of the "out-of-ink" state, similarly to the ink cartridge 100 of the first embodiment.

D. Modification

D-1. Modification 1

In the embodiments and variations described above, the pressure-receiving plate 170 and the plane section 122 of the film 120 have the irregular hexagonal shape. The pressure-receiving plate 170 and the plane section 122 are, however, not restrictively formed in the irregular hexagonal shape but may have any of other suitable shapes. Any inwardly concave shape, such as crescent or star, is not preferable, but any outwardly convex shape is preferable. For example, in a polygonal shape, the internal angles are preferably less than 180 degrees.

D-2. Modification 2

In the embodiments and variations described above, the conical spring is adopted as the negative pressure generator. The negative pressure generator is, however, not restricted to the conical spring but may be any of other diverse elements, such as a leaf spring or a resin member having flexibility.

D-3. Modification 3

In the embodiments and variations described above, the prism to be used in combination with the photo interrupter is adopted as the optical element involved in detection of the remaining volume of the liquid in the liquid chamber. The prism may, however, be replaced by any of other suitable optical elements, such as a lens, or may be replaced by a piezoelectric element or even by any of suitable detection-associated members for detection of the remaining volume of the liquid in the liquid chamber.

D-4. Modification 4

In the structure of the first embodiment, the sub-container section including the prism is provided separately from the main container section including the film as the flexible member. The structure of the first embodiment prevents the ink present in the lower area of the sub-container section below the position of the vertex angle of the prism from flowing back toward the main container section. The lower area of the sub-container section below the position of the vertex angle of the prism is accordingly the unaffected area, which is not subjected to a capacity change caused by deformation of the film. In the structure of the second embodiment, the first sub-chamber including the prism is provided below the main container section including the film as the flexible member. The first sub-chamber is accordingly the unaffected area, which is not subjected to a capacity change caused by deformation of the film. The location of the prism is, however, not restricted to those of the first embodiment and the second embodiment. In one example, the liquid chamber may be formed as an integral single chamber without any sub-chamber. The flexible member is located in an upper area of the liquid chamber, and the prism is located in a lower area of the liquid chamber. The detection-associated member, such as the prism, may be located in any unaffected area, which is not subjected to a capacity change caused by deformation of the flexible member.

D-5. Modification 5

In the structure of the first embodiment described above, the air-permeable film 142 is set in the air open hole 140. The air-permeable film 142 may be replaced with a metal mesh, such as SUS mesh. The small SUS mesh enables formation of a meniscus on the ink surface.

D-6. Modification 6

The ink cartridges of the embodiments and variations described above are for the printers in domestic or office use. The liquid container of the invention is also applicable to an ink cartridge for a large printer in business use.

D-7. Modification 7

The above embodiments and variations describe the ink cartridge and the inkjet printer. The principle of the present invention is generally applicable to a liquid ejection device configured to eject or jet any liquid other than ink and to a liquid container configured to contain such a liquid. The liquid container of the invention may be used in any of various liquid-consuming devices with a liquid ejection head for ejecting small liquid droplets. Here the term "droplet" represents a state of liquid ejected from the liquid ejection device and may be a granular shape, a teardrop shape, or a tailing shape. The term "liquid" represents any material that is ejectable from the liquid ejection device. The liquid may be any of liquid-phase materials including liquids of high viscosity and liquids of low viscosity, sols, gels, water, various inorganic solvents, various organic solvents, solutions, liquid resins, liquid metals (fused metals), and diversity of other fluids. The liquid may include the particles of any of functional solid materials, such as colorant particles or metal particles, dissolved, dispersed, or mixed in any suitable solvent. Typical examples of the liquid include ink described in the above embodiments and liquid crystal. The "ink" includes aqueous inks, oil inks, gel inks, hot-melt inks, and other various liquid compositions. Typical examples of the "liquid ejection device" include a liquid ejection device configured to eject any of dispersions or solutions of electrode materials or colorants used for manufacturing liquid crystal displays, EL (electroluminescence) displays, surface-emitting displays, or color filters, a liquid ejection device configured to eject any of bioorganic materials used for manufacturing biochips, and a liquid ejection device used as precision pipette and configured to eject any of sample liquids. The "liquid ejection device" may also be a liquid ejection device configured to eject lubricating oil at exact positions on precision machinery, such as watches and cameras, a liquid ejection device configured to eject any of transparent liquid resins, such as ultraviolet curable resin, onto a substrate for manufacturing hemispherical microlenses (optical lenses) for optical communication elements, or a liquid ejection device configured to eject any of acid or alkaline etching solutions for etching substrates. The principle of the invention is applicable to any of such liquid ejection devices and liquid containers, as well as to any of suitable liquid-consuming devices.

Among the various constituents and components included in the respective embodiments discussed above, those other than the constituents and components disclosed in independent claims are additional and supplementary elements and may be omitted according to the requirements. The invention is not limited to any of the embodiments and their applications discussed above but may be actualized in diversity of other embodiments and applications within the scope of the invention. All such modifications and changes that come within the meaning and range of equivalency of the claims are to be embraced within their scope.

What is claimed is:

1. A liquid container configured to contain a liquid to be supplied to a liquid-consuming device, the liquid container comprising:

a liquid chamber defined by a container body and a flexible member that is sealed to the container body, the liquid chamber being configured to contain the liquid, and configured so that the flexible member is subject to collapsing deformation to decrease a volume of the liquid chamber with a decrease in the internal pressure of the liquid chamber as a result of the consumption of the liquid from the liquid chamber;

a negative pressure generator configured to maintain negative pressure in the liquid chamber by applying pressure to the flexible member to oppose the collapsing deformation of the flexible member;

a liquid outlet configured to feed the liquid out of the liquid chamber;

an air inlet configured to introduce air into the liquid chamber; and a detection-associated member configured for detection of the liquid in the liquid chamber, the detection-associated member being located inside the liquid chamber;

wherein the container body has at least a first wall and a second wall intersecting with the first wall, the detection associated member is positioned on the second wall, the liquid is contained between the first wall and the flexible member, and the negative pressure generator is positioned on the first wall and is configured to apply the pressure to the flexible member in a direction away from the first wall; and wherein the liquid chamber comprises:

a main chamber configured to be subjected to a capacity reduction caused by the collapsing deformation of the flexible member as ink is consumed from the main chamber; and a sub-chamber having significantly smaller capacity than that of the main chamber provided downstream of the main chamber, the detection-associated member being located in the sub-chamber.

2. The liquid container in accordance with claim 1, wherein the detection-associated member is a prism.

3. The liquid container in accordance with claim 1, the sub-chamber comprising:

a first sub-chamber defined by the container body and the flexible member, the first sub-chamber being located between the main chamber and the liquid outlet, the detection-associated member being located inside in the first sub-chamber and being located on the wall, the detection-associated member being configured to detect the liquid in the first sub-chamber; and a second sub-chamber defined by the container body and the flexible member and located between the first sub-chamber and the liquid outlet.

4. The liquid container in accordance with claim 1, the air inlet configured to introduce air into the liquid chamber when the volume of the liquid chamber is decreased, the air inlet being configured to terminate the introduction of the air into the liquid chamber after the air is introduced into the liquid chamber.

5. A liquid container configured to contain a liquid to be supplied to a liquid-consuming device, the liquid container comprising:

a liquid chamber defined by a container body and a flexible member that is sealed to the container body, the liquid chamber being configured to contain the liquid, and configured so that the flexible member is subject to collapsing deformation to decrease a volume of the liquid chamber with a decrease in the internal pressure of the liquid chamber as a result of the consumption of the liquid from the liquid chamber;

a negative pressure generator configured to maintain negative pressure in the liquid chamber by applying pressure to the flexible member to oppose the collapsing deformation of the flexible member;

a liquid outlet configured to feed the liquid out of the liquid chamber;

an air inlet configured to introduce air into the liquid chamber; and a detection-associated member configured for detection of the liquid in the liquid chamber, the detection-associated member being located inside the liquid chamber;

wherein the container body has at least a first wall and a second wall intersecting with the first wall, the detection associated member is positioned on the second wall, the liquid is contained between the first wall and the flexible member, and the negative pressure generator is positioned on the first wall and is configured to apply the pressure to the flexible member in a direction away from the first wall; and wherein the detection-associated member is located below a boundary of an affected area inside the liquid container when the liquid container is in an operation corresponding to the orientation of the liquid container as installed in the liquid-consuming device, the affected area being subjected to a capacity change caused by the collapsing deformation of the flexible member.

6. The liquid container in accordance with claim 5, wherein the detection-associated member is a prism.

7. The liquid container in accordance with claim 5, the air inlet configured to introduce air into the liquid chamber when the volume of the liquid chamber is decreased, the air inlet being configured to terminate the introduction of the air into the liquid chamber after the air is introduced into the liquid chamber.

8. A liquid container configured to contain a liquid to be supplied to a liquid-consuming device, the liquid container comprising:

a main chamber defined by a container body and a flexible member that is sealed to the container body, the container body having a first wall and a second wall, the main chamber being configured to contain the liquid between the first wall and the flexible member, the flexible member being subject to deformation in a direction towards the first wall with a decrease in internal pressure of the main chamber resulting from the consumption of the liquid from the main chamber, the main chamber including a negative pressure generator being positioned on the first wall, the negative pressure generator being configured to maintain negative pressure in the main chamber by applying pressure to the flexible member in a direction away from the first wall;

a liquid outlet arranged on the second wall of the container body, the liquid outlet configured to feed the liquid out of the liquid container;

a first sub-chamber located between the main chamber and the liquid outlet, the first sub-chamber including a detection-associated member arranged on the second wall of the container body, the detection-associated member being configured to detect a remaining liquid in the first sub sub-chamber; and a second sub-chamber located between the first sub chamber and the liquid outlet.

9. The liquid container in accordance with claim 8, wherein the first sub-chamber is defined by the container body and the flexible member.

10. The liquid container in accordance with claim 9, wherein the second sub-chamber is defined by the container body and the flexible member.

11. The liquid container in accordance with claim 8, further comprising:

an air inlet configured to introduce outside air into the main chamber when the negative pressure generator is compressed and the internal pressure of the main chamber is lowered to or below a preset level when a volume of the main chamber is decreased, the air inlet being configured to terminate the introduction of the air into the main chamber after the air is introduced into the main chamber.

12. The liquid container in accordance with claim 8, the air inlet configured to introduce air into the liquid chamber when the volume of the liquid chamber is decreased, the air inlet being configured to terminate the introduction of the air into the liquid chamber after the air is introduced into the liquid chamber.

13. A liquid container configured to contain a liquid to be supplied to a liquid-consuming device, the liquid container comprising:

a main chamber defined by a container body and a flexible member that is sealed to the container body, the main chamber being configured to contain the liquid, the flexible member being subject to collapsing deformation with a decrease in the internal pressure of the main chamber;

a spring configured to maintain internal pressure in the main chamber by applying pressure to the flexible member to oppose the collapsing deformation;

a liquid outlet arranged on a wall of the liquid container, the liquid outlet configured to feed the liquid out of the container body;

a first sub-chamber being located between the main chamber and the liquid outlet, the first sub-chamber including a detection-associated member arranged on the wall of the container body, the detection-associated member configured to detect the presence of liquid in the first sub-chamber; and a second sub-chamber located between the first sub chamber and the liquid outlet.

14. The liquid container in accordance with claim 13, further comprising:

an air inlet configured to introduce outside air into the main chamber when a volume of the main chamber is decreased, the air inlet being configured to terminate the introduction of the air into the main chamber after the air is introduced into the main chamber.

* * * * *